US010468790B2

(12) United States Patent
Imtiaz et al.

(10) Patent No.: US 10,468,790 B2
(45) Date of Patent: Nov. 5, 2019

(54) COAXIAL PLUG CONNECTOR

(71) Applicant: IMS Connector Systems GmbH, Löffingen (DE)

(72) Inventors: Muhammad Imtiaz, Bräunlingen (DE); Kai Numssen, Frankfurt am Main (DE)

(73) Assignee: IMS Connector Systems GmbH, Loffingen (DE)

( * ) Notice: Subject to any disclaimer, the term of this patent is extended or adjusted under 35 U.S.C. 154(b) by 0 days.

(21) Appl. No.: 16/041,474

(22) Filed: Jul. 20, 2018

(65) Prior Publication Data

US 2019/0036240 A1 Jan. 31, 2019

(30) Foreign Application Priority Data

Jul. 27, 2017 (DE) ..... 10 2017 117 004

(51) Int. Cl.

| | |
|---|---|
| ***H01R 9/05*** | (2006.01) |
| ***H01R 13/11*** | (2006.01) |
| ***H01R 13/18*** | (2006.01) |
| ***H01R 13/627*** | (2006.01) |
| ***H01R 24/40*** | (2011.01) |
| ***H01R 24/50*** | (2011.01) |
| ***H01R 24/54*** | (2011.01) |
| *H01R 103/00* | (2006.01) |

(52) U.S. Cl.

CPC ..... *H01R 9/05* (2013.01); *H01R 13/111* (2013.01); *H01R 13/18* (2013.01); *H01R 13/6277* (2013.01); *H01R 24/40* (2013.01); *H01R 24/50* (2013.01); *H01R 24/542* (2013.01); *H01R 2103/00* (2013.01)

(58) Field of Classification Search

CPC .... H01R 13/6277; H01R 13/111; H01R 9/05; H01R 24/40; H01R 13/18; H01R 9/0512

USPC ..... 439/578

See application file for complete search history.

(56) References Cited

U.S. PATENT DOCUMENTS

| | | | | |
|---|---|---|---|---|
| 5,269,702 | A | 12/1993 | Bacher et al. | |
| 6,217,382 | B1 * | 4/2001 | Ziers | H01R 9/0512 439/181 |
| 6,497,579 | B1 | 12/2002 | Garbini | |
| 9,423,481 | B2 * | 8/2016 | Hechtfischer | G01R 35/007 |
| 2007/0212949 | A1 | 9/2007 | Mayer et al. | |

FOREIGN PATENT DOCUMENTS

| | | |
|---|---|---|
| DE | 102006011116 | 9/2007 |

OTHER PUBLICATIONS

German Patent Office, "Office Action" issued in German Patent Application No. 10 2014 117 004.9, dated Mar. 6, 2018, document of 8 pages.

* cited by examiner

*Primary Examiner* — Jean F Duverne

(74) *Attorney, Agent, or Firm* — Akerman LLP; Peter A. Chiabotti

(57) ABSTRACT

A coaxial plug connector, comprising at least one electrically conductive inner conductor, an electrically conductive outer conductor spaced apart from the at least one inner conductor and disposed around the at least one inner conductor, at least one sleeve, which is made of an insulating plastic, wherein the inner conductor is disposed on an inside circumferential surface of the sleeve, wherein the outer conductor is disposed on an outside circumferential surface of the sleeve, wherein the coaxial plug connector is single-piece and sleeve-like.

15 Claims, 3 Drawing Sheets

COAXIAL PLUG CONNECTOR

CROSS-REFERENCE TO RELATED APPLICATIONS

This application claims priority to German Patent Application No. 10 2017 117 004.9, filed Jul. 27, 2017, which is incorporated by reference in its entirety.

BACKGROUND

The present application relates to a coaxial plug connector and a method for its manufacture and a device having such a coaxial plug connector.

Various designs of coaxial plug-in connections are known from prior art. Coaxial plug-in connections are typically used for connecting or coupling an antenna, a filter, an amplifier, or another coaxial cable to a chassis, such as a radio or a control device. Such a plug-in connection typically comprises an electrically conductive inner conductor, an electrically conductive outer conductor, and an insulator which is disposed between the inner conductor and the outer conductor and electrically separates the inner conductor from the outer conductor.

Such a coaxial plug connector is for example known from DE 10 2006 011 116, wherein a first and a second plug component are coupled to each other such that a frictional and electrical connection is created between the respective inner conductor and the respective outer conductor, which ensures electric data transfer that is as interference-free as possible. Particularly high frequency signals require both electrical and magnetic shielding of the inner conductor, which is for example achieved by grounding the outer conductor.

It is a disadvantage of prior art that particularly coaxial plug connectors are very complicated and costly to manufacture and that the connection, particularly if multiple connections are made simultaneously, is difficult and complicated to achieve due to the tolerances.

SUMMARY

It is therefore the problem of the present application to propose an alternative coaxial plug connector, a method for manufacturing the same, and a device having such a coaxial plug connector, which can be manufactured easily and at low cost, make assembly simpler, and allow generous tolerances.

This problem is solved by a coaxial plug connector, a method for manufacturing such a coaxial plug connector, and a device having the features and structures recited herein. Advantageous embodiments and further developments are disclosed.

The coaxial plug connector according to the present disclosure comprises at least one electrically conductive inner conductor, an electrically conductive outer conductor disposed at a spacing around the at least one inner conductor, at least one sleeve made of an insulating plastic, wherein the inner conductor is disposed on an inside circumferential surface of the sleeve, wherein the outer conductor is disposed on an outside circumferential surface of the sleeve, and wherein the coaxial plug connector is made in one piece and tubular.

The coaxial plug connector is characterized in that it is designed as a one-piece sleeve having an annular cross section in a longitudinal axis. The robust one-piece design of the coaxial plug connector makes handling it simple and uncomplicated, and it also requires little material, particularly with respect to ecological manufacturing with few waste products and ecologically compatible manufacturing processes.

According to another embodiment of the present application, it is particularly advantageous to make the inner conductor and/or the outer conductor of a metalized plastic. Metalized plastics on the one hand have good electrically conductivity and on the other hand are easy to process. Their elastic properties are particularly well suited for generous manufacturing tolerance.

The coaxial plug connector is advantageously manufactured in a multi-component injection molding process, wherein a first component is an electrically insulating plastic and a second component is a metalized plastic, wherein the metalized plastic makes up the inner conductor and the outer conductor and the electrically insulating plastic makes up the sleeve between the inner conductor and the outer conductor. Such a coaxial plug connector can be manufactured particularly cost efficiently in one step.

The plastic can preferably be foamed and/or corrugated on the inside circumferential surface and/or the outside circumferential surface to give the coaxial plug connector flexibility and allow compensation for tolerances.

According to another embodiment of the present application, it is advantageous to equip the inner conductor and/or the outer conductor on a first free end with a first end face or on a second free end with a second end face. The coaxial plug connector or its inner conductor and/or outer conductor, respectively, therefore have a sufficiently large contact surface to be solderable as a SMT (surface-mount device) or using THC (through hole technology) on a PCB (printed circuit board). The annular inner conductor and the annular outer conductor should consequently have a minimum width of the web or layer thickness of approx. 0.1 mm to 0.5 mm to provide sufficient area for a solder connection.

Furthermore, the application relates to a method for manufacturing a coaxial plug connector having a sleeve, on the inside circumferential surface of which the inner conductor is disposed and on the outside circumferential surface of which the outer conductor is disposed. The coaxial plug connector can either be manufactured in a single step by means of a two-component spraying method or a multi-component injection molding method, wherein the first component is a metalized and electrically conductive plastic, which forms the inner conductor and the outer conductor and the second component is an electrically insulating plastic, which forms the sleeve. Alternatively, the coaxial plug connector can be manufactured in a multi-part process, wherein the sleeve is provided first and then the inside circumferential surface and the outside circumferential surface of the sleeve are coated with an electrically conductive material. In another step to finalize the method, a sacrificial region can be removed on a first free end and on a second free end, respectively, for galvanic separation of the inner conductor and the outer conductor.

The present application further relates to a device having at least one coaxial plug connector disclosed herein, wherein the device includes at least one coaxial plug connector and at least one plug socket, wherein the plug socket comprises at least one spring cage and at least one spring tip. The spring cage and spring tip are coaxial, spaced apart and electrically insulated and arranged such that the spring cage is disposed around the spring tip and adapted to make an electrical connection with the outer conductor. The spring tip on the other hand is adapted to make an electrical connection with the inner conductor in the region of the inside circumferential surface.

Furthermore advantageously, the spring cage may on one connection side comprise at least one elastic spring tongue by which sections of the spring cage are biased and pressed against the outer conductor of the coaxial plug connector. This produces a reliable electrical connection between the spring cage and the outer conductor.

The spring tip is advantageously made out of at least one elastic spring leaf by which sections of the spring tip are biased and pressed against the inner conductor of the coaxial plug connector. The clamping connection between the spring tip and the inner conductor on the one hand ensures the mechanical connection between the plug socket and the coaxial plug connector and on the other hand ensures good contacting of the electrically conductive elements.

The plug socket is advantageously disposed on a mounting plate. The mounting plate in addition comprises a through hole into which the spring tip of the plug socket is inserted. The mounting plate is made of an electrically insulating material and keeps the spring cage and the spring tip coaxial and electrically insulated in a predetermined position along a longitudinal axis. The mounting plate is a circuit board, which may also contain metalized through holes and conductor tracks. The spring cage must contact the conductive through hole.

It is preferred that the spring cage and/or the spring tip are gold-plated and/or silver-plated. Precious metals are known to prevent corrosion and thus contribute to the reliability and solderability of the electric plug connectors.

The plug socket is preferably designed as a housing bush or housing plug. The device according to the present application thus comprises a plug connector as well as a mounting plate, for example a housing chassis having a through hole, wherein the plug socket is fastened to the housing chassis or the mounting plate, the spring tip sits in the through hole and is connected to electric conductor tracks on the side of the mounting plate or through hole that faces away from the plug socket.

BRIEF DESCRIPTION OF THE DRAWINGS

The disclosure of the present application is explained in greater detail with reference to drawings below. Wherein.

DETAILED DESCRIPTION

A device 1 in accordance with a preferred exemplary embodiment and two further developments are described in detail below with reference to FIGS. 1*a* to 3*b.*

Figure 1B:
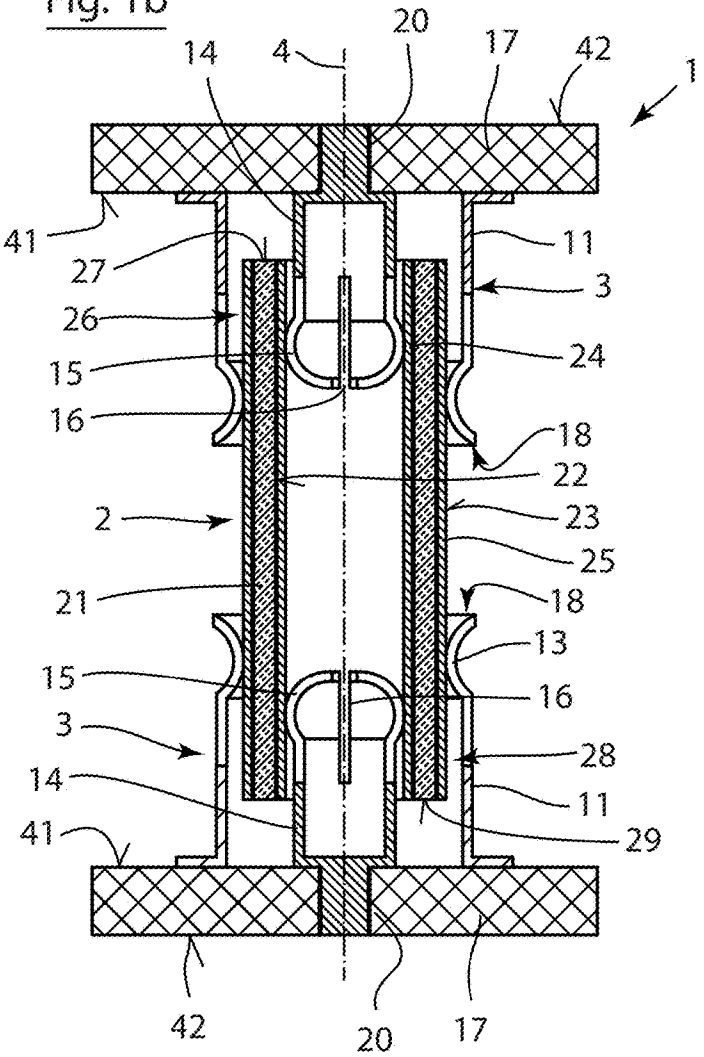
FIG. 1*b* shows a lateral sectional view of the device of the present application according to FIG. 1*a* having the coaxial plug connector, which connector has an annular cross section and includes an inner conductor, a sleeve, and an outer conductor and is inserted in the plug socket, which is disposed on the mounting plate.
Figure 1A:
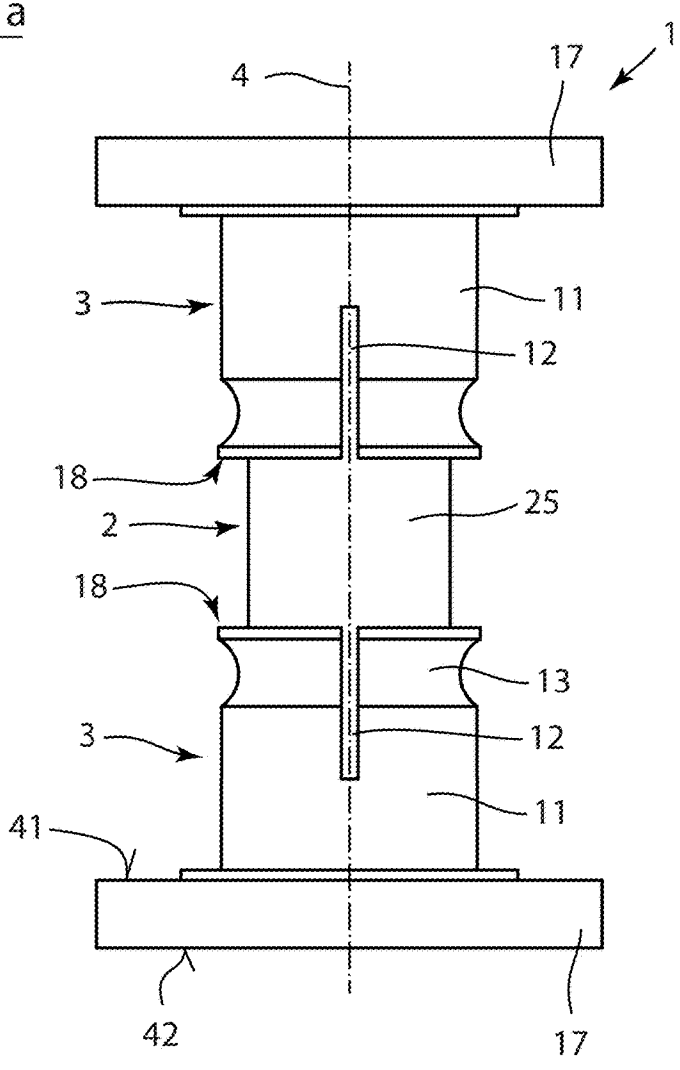
FIG. 1*a* shows a side view of a first embodiment of a device according to the present application having a coaxial plug connector and two plug sockets.

FIGS. 1*a* and 1*b* show the device 1 according to a first exemplary embodiment. The device 1 comprises a coaxial plug connector 2, which creates an electric connection between two plug sockets 3 which are disposed coaxially and spaced apart along a longitudinal axis 4. The plug sockets 3 are each disposed on a mounting plate 17 and include a spring cage 11 and a spring tip 14, which are coaxially aligned on the longitudinal axis 4. The respective spring cage 11 and the respective spring tip 14 project in alignment with each other from the mounting plate 17, wherein the spring cage 11 extends beyond the spring tip 14 in the longitudinal axis 4. The sides of the plug sockets 3 which face away from the mounting plates 17 each form a connection side 18.

The spring cage 11 is sleeve-shaped and has an annular cross section and surrounds the spring tip 14. Furthermore, the spring cage 11 comprises two or more slots 12, whereby two elastically deformable spring tongues 13 are formed.

The spring tip 14 is substantially a rotationally symmetrical body in which slots 16 are formed or onto which slots are molded, whereby elastically deformable spring leaves 15 are formed. The spring leaves 15 have a domed shape on the connection side 18.

The mounting plate 17 is designed as a circuit board having metalized through holes, wherein one or more conductor tracks 19 are disposed on the outer side 41 of the mounting plate 17 that faces the plug socket 3 and one or more conductor tracks 19 are disposed on the inner side 42 of the mounting plate 17 that faces away from the plug socket. An electrically conductive through hole 20 into which the spring tip 14 is inserted is formed coaxially with the longitudinal axis 4 in the mounting plate 17. The spring tip 14 is connected to a conductor track 19 on the inner side 42, while the spring cage 11 is connected to a conductor track 19 on the outer side 41. Such a mounting plate 17 can be a single-layer or multi-layer circuit board.

The coaxial plug connector 2 is a single-piece sleeve-like body having an annular cross section and comprising a sleeve 21 with an inside circumferential surface 22 and an outside circumferential surface 23. An inner conductor 24 is applied or disposed on the inside circumferential surface 22, and an outer conductor 25 is applied or disposed on the outside circumferential surface 23. The inner conductor 24 and the outer conductor 25 are made of an electrically conductive material or material mixture and electrically insulated and kept spaced apart from each other by means of the sleeve 21. For this purpose, the sleeve 21 is made of an electrically insulating plastic, which makes it a dielectric.

The coaxial plug connector 2 is manufactured using a 2-component spraying method, wherein the first component is an electrically insulating plastic, that is, a dielectric, and forms the sleeve 21. The second component forms the inner conductor 24 and the outer conductor 25 and includes a metalized plastic, wherein the layer thickness of the inner conductor 24 and the outer conductor 25 is dimensioned sufficiently thick to ensure solderability to the conductor tracks 19 of a mounting plate 17. After spraying, the coaxial plug connector 2 can be cut to a respective length in the longitudinal axis 4, or it is prefabricated at a respective length in the spraying process.

As an alternative to the manufacturing methods presented above, the coaxial plug connector 2 can be manufactured based on a sleeve 21. The inside circumferential surface 22 and the outside circumferential surface 23 of the sleeve 21 are coated with an electrically conductive material. When coating the inside circumferential surface 22 and the outside circumferential surface 23, some electrically conductive material typically remains on the first end face 27 and the second end face 29, which has to be removed after coating. This can be done by removing a sacrificial structure 30 not shown here, which is disposed on a first end face 27 and on a second end face 29, respectively. These can also be locally removed by chemical or mechanical means.

One of the free ends 26, 28 of the coaxial plug connector 2 is inserted into a respective plug socket 3, wherein the spring tongues 13 of the plug socket 3 contact the outer conductor 25 and the spring leaves 15 of the spring tip 14 contact the inner conductor 24, such that the electrical contact pairs are connected.

The spring cage 11 and the spring tip 14 correspond to the coaxial plug connector 2 in such a manner that, when the coaxial plug connector 2 is plugged into the plug sockets 3, the spring tongues 13 are slightly and elastically bent apart while the spring leaves 15 of the spring tip 14 are elastically compressed.

To simplify the insertion of the coaxial plug connector 2 into the plug socket 3, the connection side 18 of the spring cage 11 is widened in the form of a funnel or arc.

In the inserted state of the plug connector 2, it is centered and fixed by the bias of the spring tongues 13 and the spring leaves 15 and thus held in the plug socket 3 in the manner of a clamped connection, wherein the bias ensures proper contacting to create the electrical contact pairs.

Figure 2B:
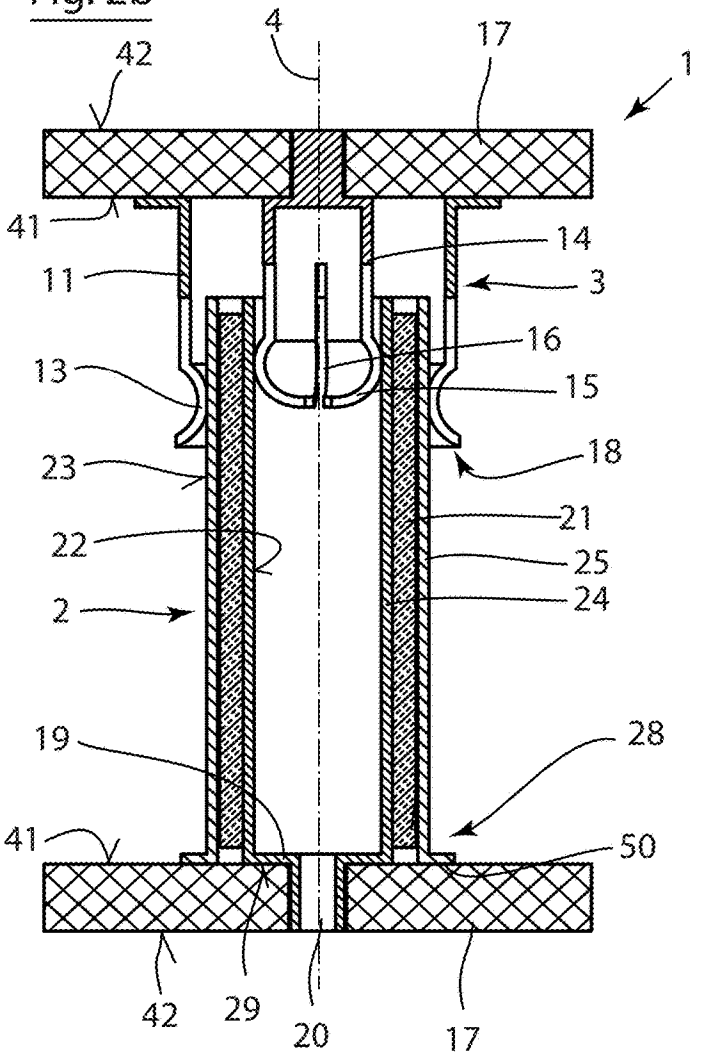
FIG. 2*b* shows a sectional view of the device of the present application according to FIG. 2*a,*
Figure 2A:
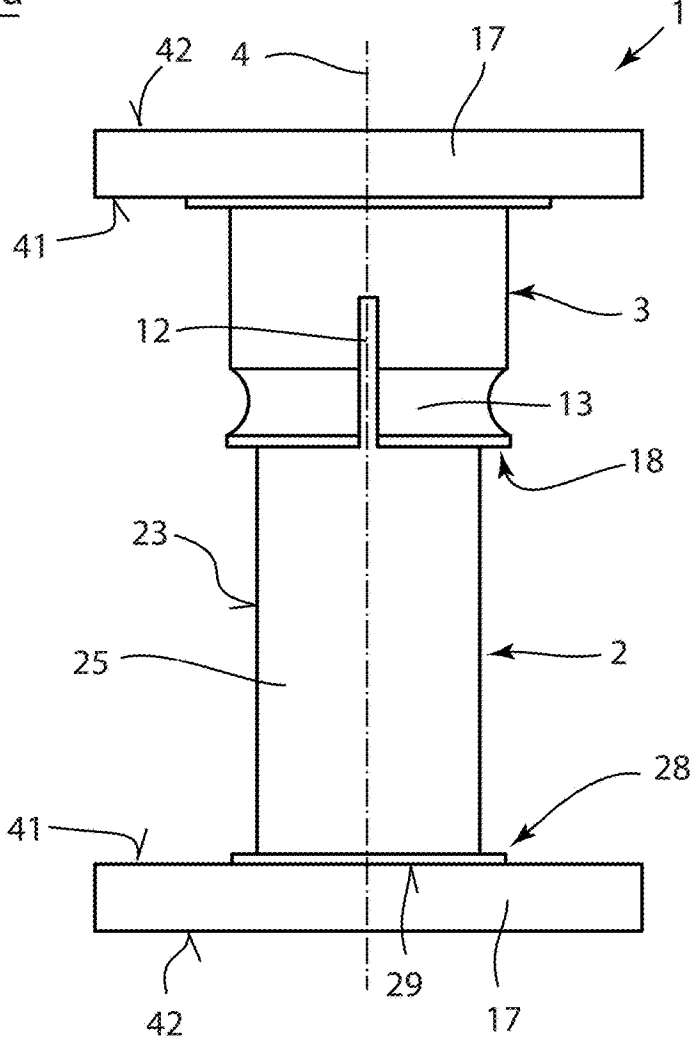
FIG. 2*a* shows a side view of a further development of the device of the present application according to FIG. 1*a,*

FIGS. 2*a* and 2*b* show a further development of the device 1. The first free end 26 of the coaxial plug connector 2 is inserted into a plug socket 3 like in the exemplary embodiment shown in FIGS. 1*a* and 1*b*. The second free end 28 is directly connected to one of the conductor tracks 19 on the outer side 41 of the mounting plate 17 by means of a solder connection 50 on the mounting plate 17, wherein the conductor track 19, which is connected to the inner conductor 24, is conducted through the through hole 20 to the inner side 42.

The contact surfaces of the inner conductor 24 and the outer conductor 25 as well as of the conductor tracks 19 must be dimensioned large enough to ensure sufficient strength of the solder connections 50. For this purpose, the surfaces of the inner conductor 24 and the outer conductor 25 on the first free end 26 and the second free end 28 are designed such that the respective annular inner conductor 24 and the annular outer conductor 25 have a minimum width or layer thickness, respectively, of approx. 0.1 mm to 0.5 mm.

Figure 3B:
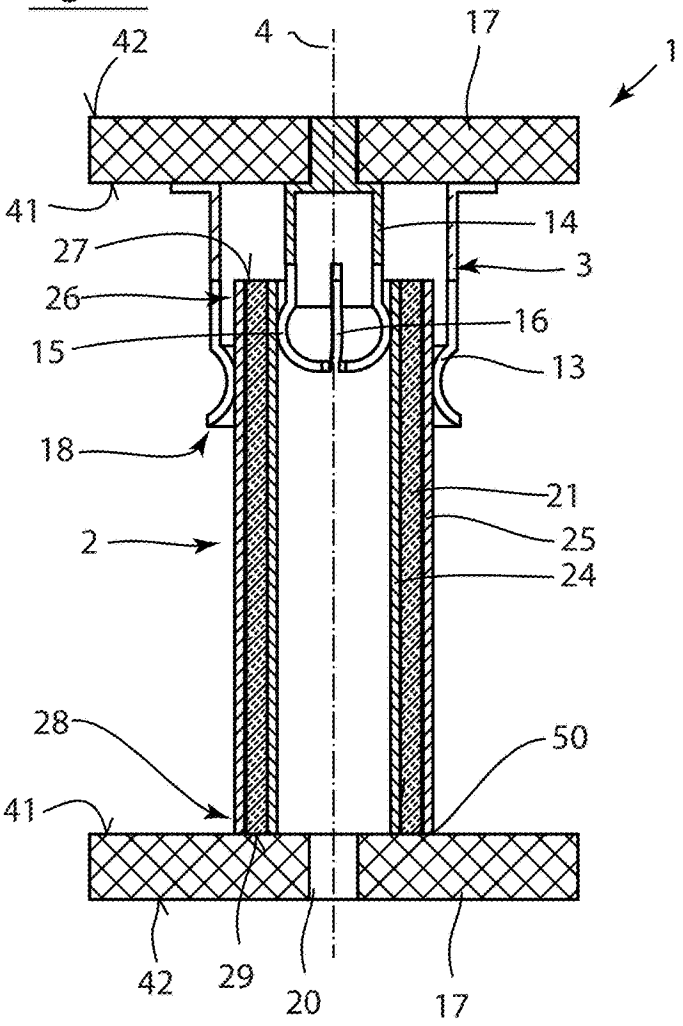
FIG. 3*b* shows a sectional view of the device of the present application according to FIG. 3*a.*
Figure 3A:
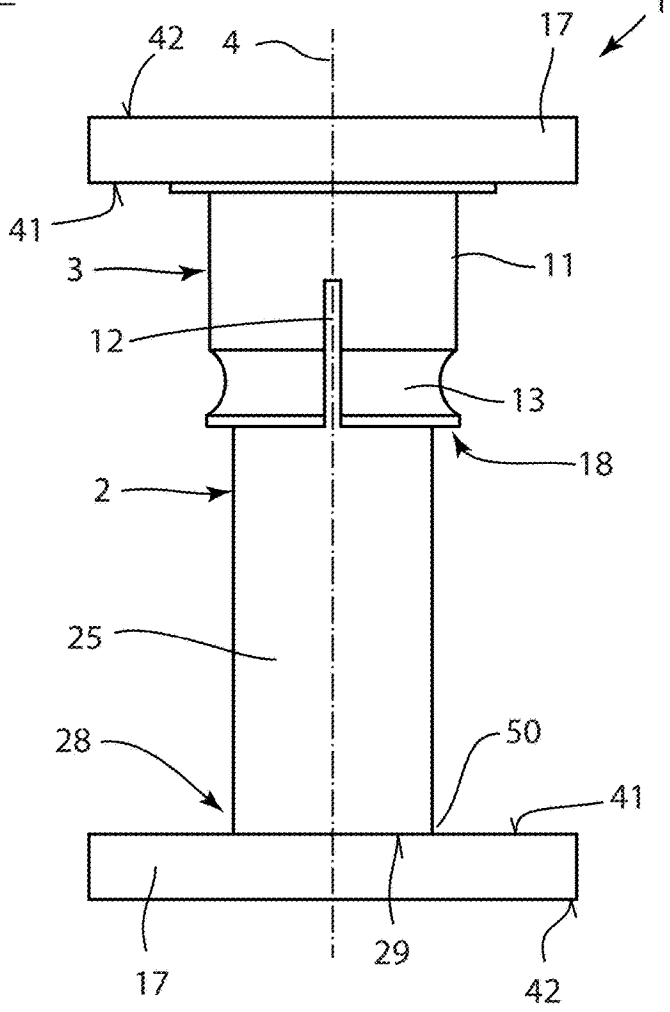
FIG. 3*a* shows a side view of a second further development of the device of the present application according to FIG. 1 having the coaxial plug connector whose inner conductor and outer conductor are each soldered to a conductor track on the mounting plate.

Another further development of the device 1 is apparent from FIGS. 3*a* and 3*b*. Particularly FIG. 3*b* shows that the inner conductor 24 and the outer conductor 25 are each on their second free end 28 connected to a conductor track 19 on the outer side 41 of the mounting plate 17. The mounting plate 17 can for example be a single-layer circuit board or a PCB (printed circuit board).

The coaxial plug connector 2 can comprise one or more slots along the longitudinal axis 4 on the first free end 26 and/or on the second free end 28. This makes the coaxial plug connector particularly elastically deformable in these regions and thus particularly immune to generous tolerances. The coaxial plug connector 2 may also comprise a continuous slot along the longitudinal axis 4, whereby the coaxial plug connector 2 has a C-shaped cross section.

Furthermore, the coaxial plug connector 2 may comprise on its first free end 26 and/or on its second free end 28 regions projecting in the longitudinal axis 4, which extend like a crown only across a partial circumference of the respective end face 27, 29. The mounting plate 17 is for example a single-layer circuit board whose conductor tracks 19 are disposed on the outer side 41. The inner conductor 24 and the outer conductor 25 of such a coaxial plug connector 2 can easily be connected by a solder connection 50 with the respective conductor track 19 through a respective design of the conductor tracks 19.

As explained above and shown in the figures, the present disclosure allows reliable and easy to assemble "board-to-board" contacting from a first mounting plate (circuit board) to a second mounting plate.

LIST OF REFERENCE SYMBOLS

1 Device
2 Plug connector
3 Plug socket
4 Longitudinal axis
11 Spring cage
12 Slot
13 Spring tongue
14 Spring tip
15 Spring leaf
16 Slot of 14
17 Mounting plate
18 Connection side
19 Conductor track
20 Through hole
21 Sleeve
22 Inside circumferential surface
23 Outside circumferential surface
24 Inner conductor
25 Outer conductor
26 First free end
27 First end face
28 Second free end
29 Second end face
30 Sacrificial region
41 Outer side
42 Inner side
50 Solder connections

The invention claimed is:

1. A coaxial plug connector, comprising:

an electrically conductive inner conductor, an electrically conductive outer conductor spaced apart from the inner conductor and disposed around the inner conductor and overlapping a length of the inner conductor, a sleeve, wherein the sleeve is made of an electrically insulating plastic, wherein the inner conductor is disposed on an inside circumferential surface of the sleeve, wherein the outer conductor is disposed on an outside circumferential surface of the sleeve, wherein the coaxial plug connector is single-piece and an elongated cylindrical body with a central opening extending through the elongated cylindrical body.

2. The coaxial plug connector according to claim 1, wherein the inner conductor, the outer conductor, or both the inner conductor and the outer conductor, are made of a metalized plastic.

3. The coaxial plug connector according to claim 1, wherein the plastic of one or more of the sleeve, the inner conductor, or the outer conductor is foamed or corrugated, or both.

4. The coaxial plug connector according to claim 1, wherein the inner conductor, the outer conductor, or both the inner conductor and the outer conductor, have a minimum layer thickness of 0.1 mm on a first free end, on a second free end, or on both a first free end and a second free end.

5. A method for the manufacture of a coaxial plug connector according to claim 1 comprising:

multi-component spraying with at least two components, wherein a first component is an electrically insulating plastic, which forms a sleeve, and wherein a second component is a metalized plastic, which forms an inner conductor, an outer conductor, or both an inner conductor and an outer conductor.

6. A method for the manufacture of a coaxial plug connector according to claim 1 comprising:

metalizing an inside circumferential surface and/or an outside circumferential surface of the sleeve.

7. A device, comprising:

an electrically conductive inner conductor, an electrically conductive outer conductor spaced apart from the inner conductor and disposed around the inner conductor, a sleeve, wherein the sleeve is made of an electrically insulating plastic, wherein the inner conductor is disposed on an inside circumferential surface of the sleeve, wherein the outer conductor is disposed on an outside circumferential surface of the sleeve, wherein the coaxial plug connector is single-piece and sleeve-shaped, a plug socket comprising:

a spring cage and a spring tip, wherein the spring cage is coaxial with, spaced apart from, and electrically insulated from the spring tip and disposed around the spring tip, wherein the spring cage contacts an outer conductor on an outside circumferential surface of the coaxial plug connector and the spring tip contacts an inner conductor on an inside circumferential surface of the coaxial plug connector.

8. The device according to claim 7, wherein one connection side of the spring cage comprises an elastic spring tongue, which is biased and presses against the outer conductor of the coaxial plug connector.

9. The device according to claim 7, wherein the spring tongues project like a funnel from outer conductor on the one connection side of the spring cage.

10. The device according to claim 7, wherein the spring tip is formed by at least one elastic spring leaf, which is biased and acts against the inner conductor of the plug connector.

11. The device according to claim 7, wherein the plug socket is disposed on a mounting plate and in that the mounting plate has an electronically conductive through hole in which the spring tip is held.

12. The device according to claim 7, wherein the spring cage, the spring tip, or both the spring cage and spring tip, are gold-plated, silver-plated, or both gold and silver plated.

13. The device according to claim 7, wherein the mounting plate is designed as a single-layer circuit board or a housing.

14. A coaxial plug connector, comprising:

an elongated electrically insulating sleeve with a sleeve length, an inside circumferential surface and an outside circumferential surface, an electrically conductive inner conductor applied to the inside circumferential surface of the sleeve, an electrically conductive outer conductor applied to the outside circumferential surface of the sleeve, wherein at least a portion of the sleeve length applied with the electrically conductive outer conductor overlaps a portion of the sleeve length applied with the electrically conductive inner conductor, wherein the elongated electrically insulating sleeve with the electrically conductive inner conductor applied to the inside circumferential surface of the sleeve and the electrically conductive outer conductor applied to the outside circumferential surface of the sleeve form an elongated cylindrical body with a central opening extending through the elongated cylindrical body.

15. The coaxial plug connector of claim 14, wherein the elongated cylindrical body is configured to insert into a spring cage and receive a plug socket, wherein the spring cage is electrically insulated from the spring tip, and wherein the spring cage contacts the electrically conductive outer conductor applied to the outside circumferential surface of the sleeve and the spring tip contacts the electrically conductive inner conductor applied to the inside circumferential surface of the sleeve.

* * * * *